US009401268B2

(12) United States Patent
Hoang et al.

(10) Patent No.: US 9,401,268 B2
(45) Date of Patent: Jul. 26, 2016

(54) MASS SPECTROMETER WITH OPTIMIZED MAGNETIC SHUNT

(71) Applicant: Luxembourg Institute of Science And Technology (LIST), Esch/Alzette (LU)

(72) Inventors: Hung Quang Hoang, Esch-sur-Alzette (LU); David Dowsett, Howald (LV); Tom Wirtz, Grevenmacher (LU)

(73) Assignee: Luxembourg Institute of Science and Technology (LIST), Luxembourg (LU)

( * ) Notice: Subject to any disclaimer, the term of this patent is extended or adjusted under 35 U.S.C. 154(b) by 0 days.

(21) Appl. No.: 14/760,642

(22) PCT Filed: Jan. 7, 2014

(86) PCT No.: PCT/EP2014/050104
§ 371 (c)(1),
(2) Date: Jul. 13, 2015

(87) PCT Pub. No.: WO2014/108376
PCT Pub. Date: Jul. 17, 2014

(65) Prior Publication Data

US 2015/0348770 A1 Dec. 3, 2015

(30) Foreign Application Priority Data

Jan. 11, 2013 (LU) ..... 92130

(51) Int. Cl.
*H01J 49/00* (2006.01)
*H01J 49/20* (2006.01)
*H01J 49/30* (2006.01)

(52) U.S. Cl.
CPC *H01J 49/20* (2013.01); *H01J 49/30* (2013.01)

(58) Field of Classification Search
USPC ..... 250/299
See application file for complete search history.

(56) References Cited

U.S. PATENT DOCUMENTS 3,337,728 A * 8/1967 Friedman ..... H01J 49/18 250/423 R
4,472,631 A * 9/1984 Enke ..... B01D 59/44 250/281
4,638,160 A * 1/1987 Slodzian ..... H01J 49/326 250/296
5,317,151 A 5/1994 Sinha et al.
6,979,818 B2 * 12/2005 Scheidemann ..... H01J 49/10 250/283

FOREIGN PATENT DOCUMENTS

GB 1400532 7/1975

OTHER PUBLICATIONS

International Search Report from corresponding International Application No. PCT/EP2014/050104, mailed Jun. 18, 2014.

* cited by examiner

*Primary Examiner* — Phillip A Johnston
(74) *Attorney, Agent, or Firm* — Polster Lieder

(57) ABSTRACT

The present invention relates to a mass spectrometer device comprising a source of ions, an electrostatic sector, a non-scanning magnetic sector arranged downstream of the electrostatic sector, for separating ions originating at the source of ions according to their mass-to-charge ratios, and a detection means. A magnetic shunt is arranged in the drift space between the electrostatic sector and the magnetic sector. The proposed position of the magnetic shunt enhances the resolving power of the mass spectrometer device.

8 Claims, 3 Drawing Sheets

MASS SPECTROMETER WITH OPTIMIZED MAGNETIC SHUNT

CROSS-REFERENCE TO RELATED APPLICATIONS

The present invention is the US national stage under 35 U.S.C. §371 of International Application No. PCT/EP201/050104, which was filed on Jan. 7, 2014, and which claims the priority of application LU 92130 filed on Jan. 11, 2013, the content of which (text, drawings and claims) are incorporated here by reference in its entirety.

FIELD

The present invention relates to a mass spectrometer. More specifically, it relates to a mass spectrometer that uses a non-scanning magnetic sector instrument that is used to separate ions according to their mass-to-charge ratio.

BACKGROUND

Mass spectrometry is an analytical technique that is commonly used to determine the elements that compose a molecule or sample. A mass spectrometer typically comprises a source of ions, a mass separator and a detector. The source of ions may for example be a device which is capable of converting the gaseous, liquid or solid phase of sample molecules into ions, that is, electrically non-neutral charged atoms or molecules. Several ionization techniques are well known in the art, and the particular structure of an ion source device will not be described in any detail in the present specification. Alternatively, the ions to be analyzed by the mass spectrometer may result from the interaction between the sample in its gaseous, liquid or solid phase and an irradiation source, such as a laser, ion or electron beam. The ion emitting sample is in that case considered to be the source of ions.

The ion beam that originates at the ion source is analyzed using a mass analyzer, which is capable of separating, or sorting, the ions according to their mass-to-charge ratio. The ratio is typically expressed as m/z, wherein m is the mass of the analyte in unified atomic mass units, and z is the number of elementary charges carried by the ion. The Lorentz force law and Newton's second law of motion in the non-relativistic case characterize the motion of charged particles in space. Mass spectrometers therefore employ electrical fields and/or magnetic fields in various known combinations in order to separate the ions created by the ion source. An ion having a specific mass-to-charge ratio follows a specific trajectory in the mass-analyzer. As ions of different mass-to-charge ratios follow different trajectories, the composition of the analyte may be determined based on the observed trajectories. By analogy with an optical spectrometer, which allows generation of a spectrum of the different wavelengths comprised in a wave beam, the mass spectrometer allows generation of a spectrum of the different mass-to-charge ratios comprised in a molecule or sample.

In order to detect the ions various known detection devices may be employed at the exit of the mass analyzer. Such detectors can be position sensitive or not, and are well known in the art. Their functioning will not be further explained in the context of the present specification. In general terms, a detector device is capable of measuring the value of an indicator quantity. It provides data for computing the abundances of each ion present in the analyte.

Sector instruments are a specific type of mass analyzing instrument. A sector instrument uses a magnetic field or a combination of an electric and magnetic field to affect the path and/or velocity of the charged particles. In general, the trajectories of ions are bent by their passage through the sector instrument, whereby light and slow ions are deflected more than heavier fast ions. Magnetic sector instruments generally belong to two classes. In scanning sector instruments, the magnetic field is changed, so that only a single type of ion is detectable in a specifically tuned magnetic field. By scanning a range of field strengths, a range of mass-to-charge ratios can be detected sequentially. In non-scanning magnetic sector instruments, a static magnetic field is employed. A range of ions may be detected in parallel and simultaneously.

The resolving power of a mass spectrometer provides a measure of a device's ability to separate two peaks of slightly different mass-to-charge ratios in the resulting mass spectrum. It is defined as $R=m/\Delta m$, where m is the mass number of the observed mass and $\Delta m$ is the difference between two masses that can be separated. The mass separation is translated into the mass dispersion along the detection plane. $\Delta m$ is determined by measuring the full width at half maximum, FWHM, of the peak corresponding to mass m. The resolving power may not be the same across a range of observed mass ranges.

The Mattauch-Herzog mass spectrometer, as described in J. Mattauch and R. Herzog, Z. Phys., 89, 786 (1934) is a typical high performance wide range parallel mass spectrometric sector-type instrument. As a mass analyzer, the device uses an electrostatic sector followed by a non-scanning magnetic sector. The device provides double focusing of ions on a single straight focal plane at the exit of the magnetic sector, where a range of masses can be detected simultaneously. The principle of double focusing is that ions with different energies and different angles are brought into focus in the same plane. The simultaneous parallel detection improves the detection efficiency and improves the quantitative performance of the device as compared to scanning mass spectrometers. The time dependent fluctuations of the system are eliminated. However, devices using the Mattauch-Herzog geometry normally use a large magnetic sector in order to achieve high performance on a large mass range.

Some variations of the geometry have been proposed as compact mass spectrometers for space exploration, for example in A. O. Nier and J. L. Hayden, Int. J. Mass Spectrom. Ion. Phys., 6, 339 (1971), in M. P. Sinha and M. Wadsworth, Rev. Sci. Instrum. 76, 025103 (2005) or in M. Nishiguchi et al., J. Mass Spectrom. Soc. Jpn, 55, 1 (2006). However, the performance of these designs is limited. The range of mass-to-charge ratios that is detectable in parallel for a single acquisition spans less than ten units, and the mass resolution is limited from tens to a few hundreds.

Patent document GB 1 400 532 A discloses a mass spectrometer device in which a magnetic shunt is arranged downstream of the electrostatic sector and upstream of the magnetic sector.

Patent document U.S. Pat. No. 5,317,151 discloses a miniature sector parallel mass spectrometer. The achieved mass resolution is of 330 FWHM. The achieved mass resolution is reported in M. P. Sinha and M. Wadsworth, Rev. Sci Instrum, 76 025103 (2005), which relates to the same device.

Such known devices are therefore ill-suited for applications where a range of masses from 1 to 35 atomic mass units (amu) at a resolution of at least 1500 is required.

A typical application where such high performance is required lies for example in the area of nitrate pollution detection in surface waters. To date, the N-isotope field still relies on cumbersome sampling and on complex large scale laboratory spectrometers. A portable field mass spectrometer for the analysis of O and H isotopes and for the analysis of $^{15}N$ and $^{18}O$ of nitrate would require a mass resolution of at least 1500 in order to eliminate mass interferences, and it would have to be lightweight and robust.

SUMMARY

It is an objective of the present invention to provide a mass spectrometer, which comprises a non-scanning magnetic sector instrument, and which overcomes at least some of the disadvantages of the prior art.

According to various embodiments of the invention, a spectrometer device comprising a source of ions, a non-scanning magnetic sector for separating ions originating at the source of ions according to their mass-to-charge ratios, and detection means is provided. The magnetic sector comprises an ion entrance plane and at least two ion exit planes, which are arranged at different angles with respect to the ion entrance plane. The source of ions can be an ion source device, or a sample that is emitting ions under incident radiation.

In various embodiments, the magnetic sector can comprise two ion exit planes, which are arranged at different angles with respect to the ion entrance plane The first exit plane, which corresponds to a first ion mass range, can be arranged at a first angle with respect to the entrance plane, wherein the second exit plane, which corresponds to a second ion mass range, can be arranged at a second angle with respect to the entrance plane. The first angle can advantageously have a narrower opening than said second angle. Therefore, the first angle is smaller than the second angle.

In various embodiments, it can further be that the values of the angles are such that the difference between the second angle and the first angle can be in the range from 10° to 30°. Advantageously, the first angle can have an opening of 63°, and the second angle can have an opening of 81.5°.

The detection means can comprise at least one detector. The detector can be mounted on a positioning stage that allows changing the detector's position. In various embodiments, at least two detectors can be provided. The position of each of the detectors can generally correspond to a focal plane onto which ions exiting the magnetic sector through one of the exit planes are focused.

The magnetic sector can comprise a layered arrangement in which a yoke comprises layers of magnets and pole pieces. The magnetic sector can further comprise a central gap.

The source of ions and the magnetic sector can be arranged so that an ion beam which is generated by the source of ions hits the entrance plane of the magnetic sector at an angle with respect to the normal direction of said entrance plane. The angle can be substantially equal to 38°.

In various embodiments, the device can comprise and electrostatic sector arranged downstream of the ion source and upstream of the magnetic sector.

Further, a magnetic shunt can be arranged downstream of the electrostatic sector and upstream of the magnetic sector. The shunt can be arranged in parallel to the entrance plane of the magnetic sector. Alternatively, the shunt can be arranged at an angle with respect to the entrance plane of the magnetic sector. Even further, the shunt can be arranged in parallel to the exit plane of the electrostatic sector.

In various embodiments, the device can be portable. The electrostatic sector, the magnetic shunt, the magnetic sector and the detecting means can fit into a volume box of dimensions 20 cm by 15 cm by 10 cm.

According to various embodiments of the invention a spectrometer device comprising a source of ions, an electrostatic sector, a non-scanning magnetic sector arranged downstream of the electrostatic sector, for separating ions originating at the source of ions according to their mass-to-charge ratios, detection means and a magnetic shunt is provided. The magnetic shunt is arranged downstream of said electrostatic sector and upstream of said magnetic sector. The magnetic shunt is arranged at an angle with respect to the ion entrance plane of the magnetic sector. The position of the shunt impacts the shape of the magnetic sector's fringe field. Specifically, the fringe field in the drift space between the electrostatic sector and the magnetic sector, and more specifically along the magnetic sector's ion entrance plane, is not homogeneous due to the position of the magnetic shunt.

In various embodiments, the magnetic shunt can be arranged in parallel to the exit plane of said electrostatic sector.

The electrostatic sector can be arranged so that its exit plane forms an angle of less than 90° with respect to the normal direction of the entrance plane of the magnetic sector. The angle can be substantially equal to 38°.

Further, the magnetic shunt can be made of iron. It can comprise an opening that is adapted for the passage of an ion beam.

The spectrometer device can comprise a vacuum enclosure in which its components are located. The device can further comprise a sample inlet for introducing analytes.

In various embodiments, the mass spectrometer according to the present invention achieves a resolving power of well above 2000 for several focal planes. The resolving power can be fine-tuned for a specific mass-to-charge range by defining the exit plane geometry of the magnetic sector accordingly.

In various embodiments that find particular use in hydrological applications, for example, for isotopic analysis, two exit planes corresponding to the sub-ranges from 1 to 2 amu and from 15 to 35 are optimized. Each mass range experiences a different deflection angle through the magnetic sector and focuses onto a different focal plane. Simulation results show that all the masses of an ion beam with an angular spread of about 1° and an energy spread of about 8.5 eV, arising from a simulated ion source, are well focused along two detection planes. In the vertical direction, the beam widths are less than 2 mm. The resulting spectrometer device fits within a space 17 cm long, 11 cm wide and 7 cm high, excluding the ion source. The device according the present invention is therefore particularly well suited for portable field use applications where high performance is required. Such applications include, but are not limited to, nitrate pollution detection of surface waters, or hydrological isotopic analysis of ground water.

DRAWINGS

Several embodiments of the present invention are illustrated by way of figures, which do not limit the scope of the invention, wherein.

DETAILED DESCRIPTION

Figure 1:
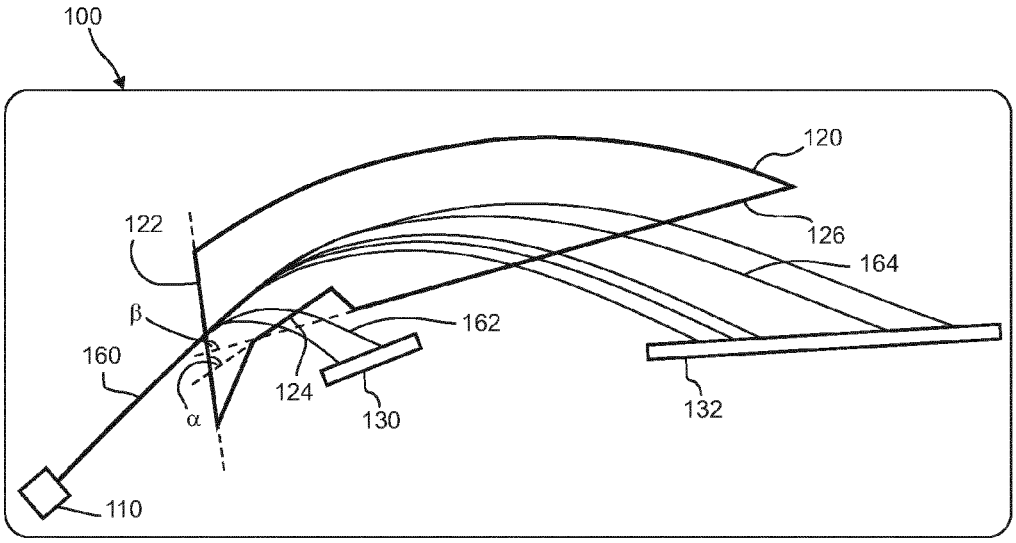
FIG. 1 is a schematic illustration of the top view of a device according to various embodiments of the invention.

This section describes the invention in further detail based on various embodiments and on the figures. Similar reference numbers will be used to denote similar concepts across different embodiments of the invention. For example, reference numerals 100, 200 and 300 will be used to denote a mass spectrometer device according to the present invention in three different embodiments.

FIG. 1 gives a schematic illustration of a spectrometer device 100 according to the present invention. The device provides an enclosure having an inlet (not shown) for introducing a sample that is to be analyzed by the technique of mass spectrometry. The enclosure encompasses a vacuum and comprises an ion source 110, a magnetic sector 120 and at least two detectors 130, 132. Throughout this description, the word detector will be used to denote a device that is capable of detecting and quantifying ions of different mass-to-charge ratios, to compute the resulting spectrum and to display the resulting spectrum. Such devices or device assemblies are well known in the art.

The ion source, or source of ions, 110 generates an ion beam 160 which hits the entrance plane 122 of the magnetic sector 120 at an angle after having passed through the drift space between the ion source and the entrance plane 122. The magnetic sector generates a permanent magnetic field, which causes the ions to follow specifically curved trajectories, depending on their specific mass-to-charge ratios. The magnetic sector 120 has a generally curved shape on one side, which is opposed to the side that comprises the ion exit planes. The generally curved shape can alternatively be provided by a set of straight segments approximating the curvature. In the embodiment of FIG. 1, a first exit plane 124 and a second exit plane 126 are provided by the magnetic sector. The first exit plane 124 is defined by an angle $\alpha$ with respect to the orientation of the entrance plane 122. The second exit plane 126 is defined by an angle $\beta$ with respect to the orientation of the entrance plane 122, wherein the angle $\beta$ is larger than the angle $\alpha$. Both the angles and the lengths of the exit planes are chosen so that a specific sub-range of ions 162, 164 exit the magnetic sector through the respective planes 124 and 126. As illustrated in FIG. 1, the shape of the magnetic sector can comprise a further planar area on the side comprising the exit planes, adjacent to the entrance plane. No ions exit through this plane, the geometry of which impacts on the shape of the magnetic sector's fringe fields.

In accordance with the present invention, the magnetic sector can comprise a plurality of exit planes arranged at different angles with respect to the entrance plane. Without loss of generality and for the sake of clarity, in the following the description will however focus in all embodiments on the case in which two distinct exit planes are provided. The lengths and angles of the exit planes can be adapted depending on the sub-ranges of mass-to-charge ranges that need to be detected.

The source of ions 110 and the magnetic sector 120 are arranged so that the ion beam 160 hits the entrance plane 122 at an angle. In various embodiments, the incident angle is less than 90°, for example, generally equal to 38°. The focal planes for both of the exit planes are located at a distance from the magnetic sector. The detector devices 130 and 132 are placed accordingly, so that the detector 130 is capable of detecting the focused sub-range 162, whereas the detector 132 is capable of detecting the focused sub-range 164.

Figure 2:
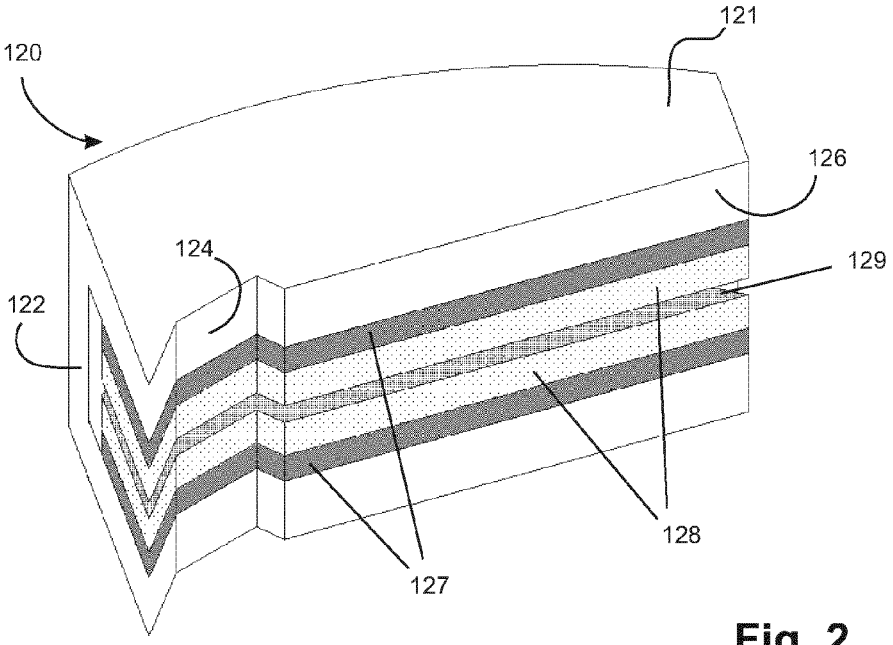
FIG. 2 is a perspective illustration of a magnetic sector instrument of a device according to various embodiments of the invention.

FIG. 2 illustrates the design of the magnetic sector 120 in a perspective view, according to various embodiments. The instrument comprises a yoke 121 that holds magnets 127 and pole pieces 128. The arrangement of the magnets 127 and the pole pieces 128 is such that from outside to inside, the magnets are followed by the pole pieces. In between the central pole pieces 128, there is a gap space 129. Ions entering the magnetic sector through the entrance plane 122 and exiting the magnetic sector through the exit plane 124 or 126, travel in the gap space 129.

The magnets 127 and pole pieces 128 form a magnetic circuit and generate a strong magnetic field inside the gap 129 between the pole pieces. In various implementations, Neodymium-Iron-Boron magnets with a high maximum energy product of 40 MGOe (320 kJ/m3) are used in order to reduce the mass of the magnets. In various embodiments, the thickness of the magnets 127 is of 6 mm. The pole pieces 128 can have a thickness of 8 mm in order to maintain the uniformity of the magnetic field in the gap space 129. The yoke 121 can have a thickness of 14 mm. In order to minimize the fringing field region near the edge of the magnetic sector, pure iron, which has a high permeability, is employed for both the yoke and the pole pieces. In various implementations, the gap space 129 can have a height of 4 mm. In various embodiments, the maximum magnetic field that can be achieved in the gap between the pole pieces is of 0.66 T.

In various alternative embodiments, the magnets can be replaced by corresponding electromagnets. Generally, the detectable range of mass-to-charge ratio of the mass spectrometer depends on the size and on the magnetic field strength of the magnetic sector.

Figure 3:
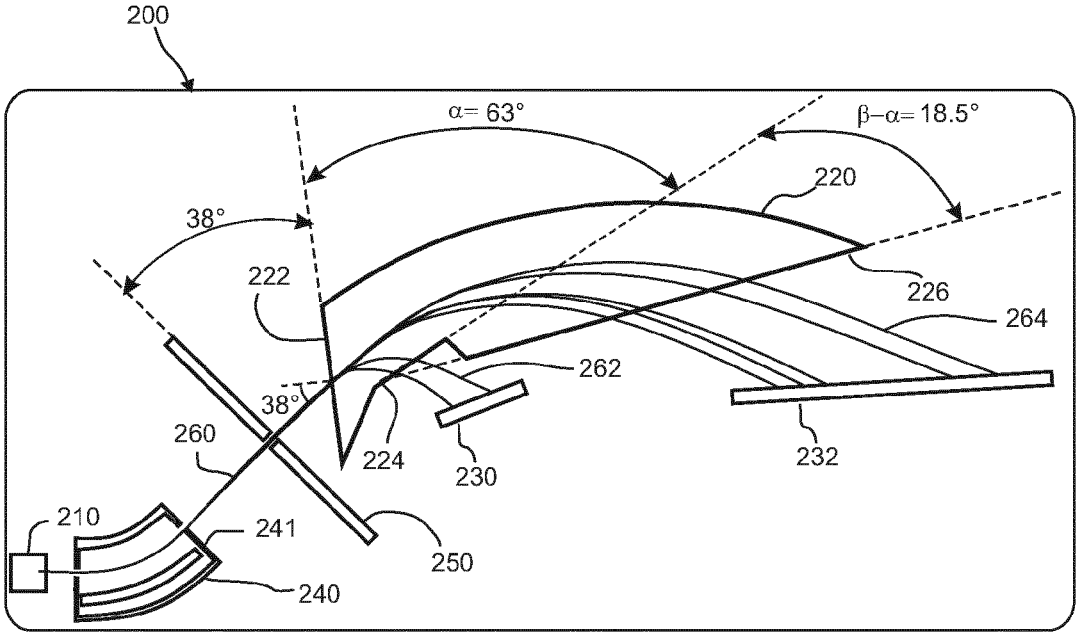
FIG. 3 is a schematic illustration of the top view of a device according to various embodiments of the invention.

FIG. 3 gives a schematic illustration of the spectrometer device 200 according to various embodiments of the present invention. The device provides an enclosure having an inlet (not shown) for introducing a sample that is to be analyzed by the technique of mass spectrometry. The enclosure encompasses a vacuum and comprises an ion source 210, a magnetic sector 220 and at least two detectors 230, 232.

The mass spectrometer device 200 further comprises an electrostatic sector 240. The electrostatic sector 240 is positioned downstream of the ion source 210 and upstream of the magnetic sector 220. A magnetic shunt 250 is placed in the drift space between the electrostatic sector 240 and the magnetic sector 220.

The ion source 210 generates an ion beam 260 which passes through the electrostatic sector 240. In various embodiments, the exit plane 241 of the electrostatic sector is aligned at an angle of less than 90° with respect to the entrance plane 222 of the magnetic sector. Advantageously, the exit plane 241 of the electrostatic sector is aligned at 38° with respect to the entrance plane 222 of the magnetic sector. This arrangement creates a positive inclination angle between the incident normal of the magnetic sector and the optical axis. This suitably forms the fringing field of the magnetic sector, in order to defocus the ion beams in the in-plane direction. Therefore, the focal planes are moved away from the exit planes 224, 226 of the magnetic sector, making it easier to mount and adjust the detectors 230, 232.

In various embodiments, a spherical electrostatic sector can be used, in order to achieve the focusing of the ion beam in both the in-plane (horizontal) and out-of-plane (vertical) directions. The focusing in the out-of-plane direction converges the ion beams into small spots in the vertical direction on the focal plane. This facilitates the use of a 1D array detector as their active region is generally limited in the vertical direction. The focusing also helps to achieve high transmission in the magnetic sector. In various embodiment, the mean radius and the angle of the spherical electrostatic sector 240 are 30 mm and 45° respectively. The gap between the electrodes of the electrostatic sector 240 is of 10 mm. The electrostatic sector is used in retarding mode, in which the outer electrode is biased to reflect the ion beam, while the inner electrode is grounded. This leads to enhanced performance. In various embodiments, the deflection electrode can be biased at 2670 V, for deflecting the ion beam having an energy of 5000 eV.

A magnetic shunt 250, which in various embodiments can be made of pure iron, is placed downstream of the electrostatic sector 240 and upstream of the magnetic sector. The aim is to prevent the magnetic fringing field from affecting the ion trajectories in the electrostatic sector. The thickness of the shunt can be about 3 mm. The arrangement of the magnetic shunt is an important parameter that impacts the performance of the mass spectrometer. In various embodiments of FIG. 3, the shunt 250, which has an opening that allows the ion beam to pass through, is placed in parallel to the exit plane 241 of the electrostatic sector 240. It is therefore inclined at 38° with respect to the entrance plane 222 of the magnetic sector 220. Thereby, a non-uniform fringing field is formed along the entrance plane of the magnetic sector. This non-uniform fringing field affects differently on ions of different incident angles and energies, and it has been observed that it improves the focusing property of the mass spectrometer in the focal planes 230, 232.

The ion beam 260 hits the entrance plane 222 of the magnetic sector 220 at an angle of 38°. The magnetic sector generates a permanent magnetic field, which causes the ions to follow specifically bent trajectories in the sector's gap, depending on their specific mass-to-charge ratios. The magnetic sector 220 has a generally curved shape on one side, which is opposed to the side that comprises the ion exit planes. In the embodiment of FIG. 3, a first exit plane 224 and a second exit plane 226 are provided by the magnetic sector. The first exit plane 224 is defined by an angle $\alpha$ with respect to the orientation of the entrance plane 222. The second exit plane 226 is defined by an angle $\beta$ with respect to the orientation of the entrance plane 222, wherein the angle $\beta$ is larger than the angle $\alpha$. Both the angles and the lengths of the exit planes are chosen so that a specific sub-range of ions 262, 264 exits the magnetic sector through the respective planes 224 and 226.

In various embodiments, the distance between the shunt and the electrostatic sector is of 2.5 cm, while the distance between the shunt and the magnetic sector is of 1.5 cm. The resulting spectrometer device occupies a footprint of generally 17 cm by 11 cm, excluding the source of ions. All the components need to be arranged in such a way that the ions of different masses are focused on a focal plane under double focusing conditions, and the focal plane needs to be located at a distance from the respective exits of the magnetic sector. In order to focus all the masses onto a focal plane under double focusing conditions, the ion beam must be collimated in the drift space between the electrostatic sector and the magnetic sector, i.e., the beam exits the electrostatic sector in parallel. This can be achieved by using a focusing lens in the ion source (not shown) to adjust the distance between the virtual ion source and the electrostatic sector. In the particular design of FIG. 3, the virtual ion source is placed at 10 mm in front of the electrostatic sector.

In various embodiments of FIG. 3, the angle $\alpha$ formed by the first exit plane 224 and the entrance plane 222 of the magnetic sector, is equal to 63°. The angle $\beta$ formed by the second exit plane and the entrance plane 222 of the magnetic sector, is equal to 81.5°. The difference between the two angles is equal to $(\beta-\alpha)=18.5°$. The first exit plane is optimized for detecting ions of masses 1 to 2 amu, while the second exit plane is optimized for the sub-range of 16 to 35 amu. This arrangement is particularly useful for hydrology applications, and even more particularly for isotopic analysis.

Figure 4:
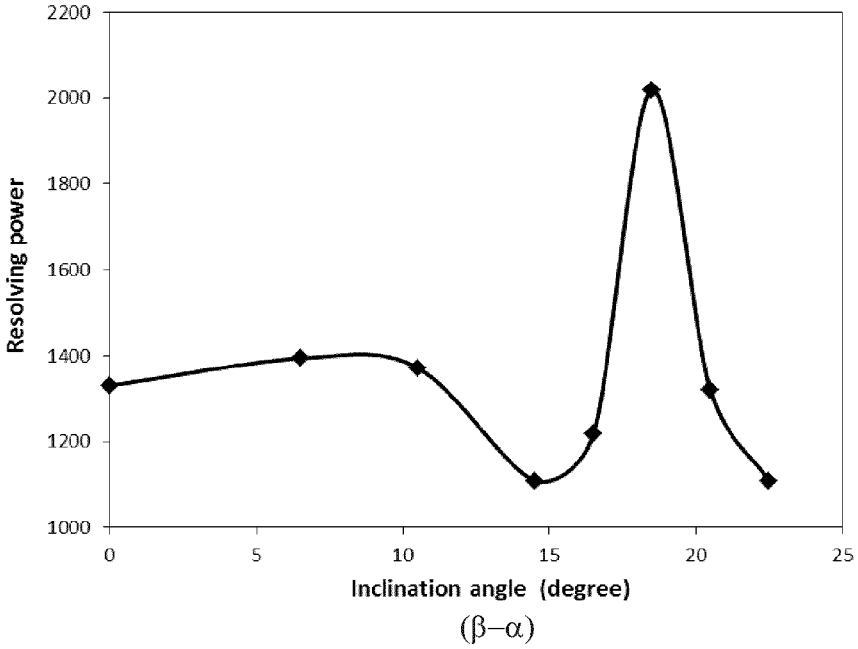
FIG. 4 is a plot showing experimental data obtained using various embodiments of the device according to various embodiments of the present invention.

FIG. 4 plots the resolving power of the mass spectrometer according to the various embodiments of FIG. 3. Specifically, the resolving power at mass 2 amu is shown as a function of the inclination angle between the first exit plane 224 and the second exit plane 226. Therefore the value of the plot at $(\beta-\alpha)=0°$ corresponds to the case where only a single continuous exit plane is provided in the magnetic sector, forming an angle of 81.5° with the entrance plane. The resolving power at mass 2 amu is of about 1350 in that case. As the first exit plane carves deeper into the body of the magnetic sector, it has been observed that the resolving power at mass 2 amu varies. A maximum has been observed at $(\beta-\alpha)=18.5°$, where the resolving power is higher than 2000. Similar optimization techniques can be used for each sub-range that is of importance for a particular application. The improvement in resolving power is significant, without increasing the overall size of the magnetic sector.

Figure 5:
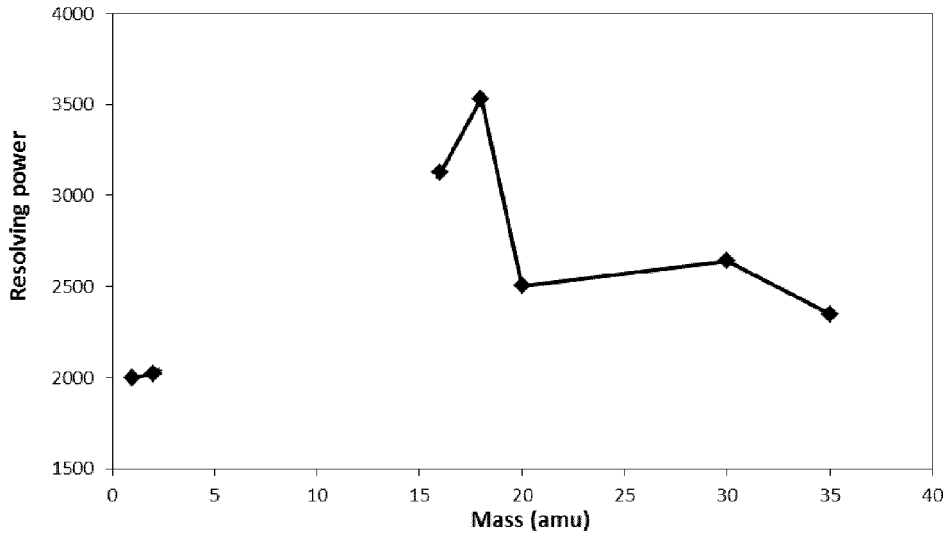
FIG. 5 is a plot showing experimental data obtained using various embodiments of the device according to various embodiments of the present invention.

FIG. 5 plots the resolving power of the mass spectrometer according to the various embodiments of FIG. 3. Specifically, the resolving power in the sub-ranges 1-2 amu corresponding to the first exit plane 224, and the second sub-range 16-35 amu corresponding to the second exit plane 226 is shown. It is appreciated that a resolving power of 2000 to above 3500 is achieved by the compact mass spectrometer according the present invention.

Figure 6:
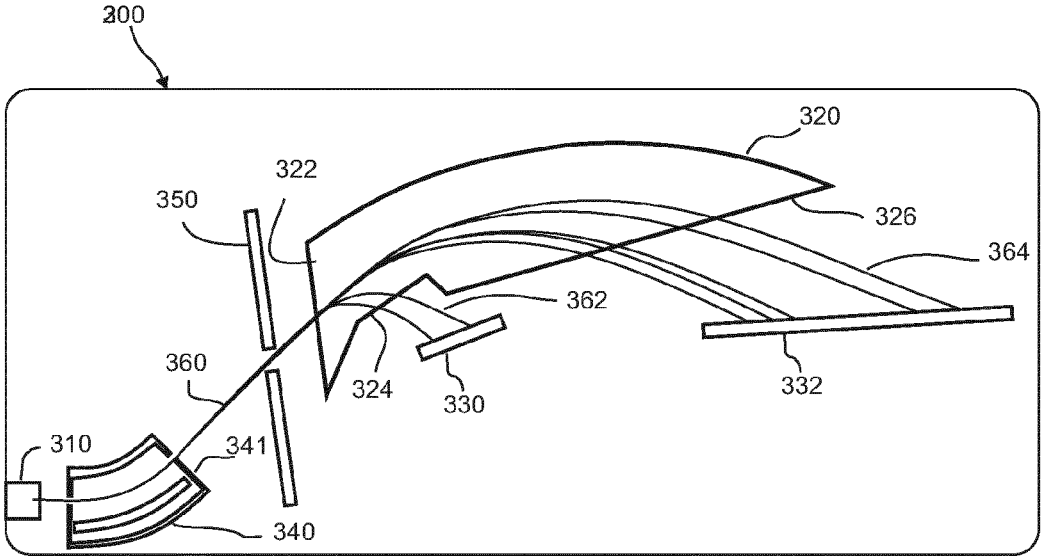
FIG. 6 is a schematic illustration of the top view of a device according to various embodiments of the invention.

FIG. 6 illustrates a mass spectrometer device, which is similar to the embodiments of FIG. 3, with the exception that the magnetic shunt 350 is arranged in parallel to the entrance plane 322 of the magnetic sector 320. According to the present invention, the position of the magnetic shunt can be adapted to take on any intermediate positions between those shown in FIG. 3 and FIG. 6. Therefore the magnetic shunt can be rotatably mounted on an axis. Experimental data shows that for a specific magnetic sector design, the shunt position shown in FIG. 3, wherein the magnetic shunt is arranged in parallel to the exit plane of the electrostatic sector, improves the overall resolving power of the mass spectrometer design.

Table 1 summarizes the observed resolving powers at masses 2 and 16 amu for the case in which the magnetic shunt is parallel to the entrance plane of the magnetic sector (FIG. 6), and for the case in which the magnetic shunt is arranged at 38° with respect to the entrance plane of the magnetic sector (FIG. 3).

TABLE 1

Resolving power comparison

| Mass (amu) | Magnetic shunt // to entrance plane (FIG. 6) | Magnetic shunt at 38° (FIG. 3) |
|---|---|---|
| 2 | 1300 | 2000 |
| 16 | 1000 | 3000 |

Again, the achieved improvement in resolving power is significant, without increasing the overall size of the mass spectrometer or of the magnetic sector.

It should be understood that the detailed description of the various embodiments is given by way of illustration only, since various changes and modifications within the scope of the invention will be apparent to those skilled in the art. The scope of protection is defined by the following set of claims.

The invention claimed is:

1. A mass spectrometer device, said comprising:

a source of ions;

an electrostatic sector;

a non-scanning magnetic sector arranged downstream of the electrostatic sector, for separating ions originating at the source of ions according to their mass-to-charge ratios, a detection means; and a magnetic shunt arranged downstream of the electrostatic sector and upstream of said magnetic sector, wherein said magnetic shunt is arranged at an angle with respect to an ion entrance plane of the magnetic sector, so that the fringe field of the magnetic sector is inhomogeneous.

2. The device according to claim 1, wherein the magnetic shunt is arranged in parallel to the exit plane of the electrostatic sector.

3. The device according to claim 2, wherein the electrostatic sector is arranged so that its exit plane forms an angle of less than 90° with respect to the normal direction of the entrance plane of the magnetic sector.

4. The device according to claim 3, wherein the electrostatic sector is arranged so that its exit plane forms an angle of generally 38° with respect to the normal direction of the entrance plane of the magnetic sector.

5. The device according to claim 4, wherein the magnetic shunt is made of iron.

6. The device according to claim 5, wherein the magnetic shunt comprises an opening that is adapted for the passage of an ion beam originating at the source of ions.

7. The device according to claim 6, wherein the device further comprises a vacuum enclosure.

8. The device according to claim 7, wherein the device further comprises a sample inlet.

* * * * *